United States Patent [19]

Barron

[11] 4,215,434

[45] Aug. 5, 1980

[54] PATIENT'S HOSPITAL GOWN

[76] Inventor: Jeanette W. Barron, 53 Beatrice Cir., Belmont, Mass. 02178

[21] Appl. No.: 18,465

[22] Filed: Mar. 7, 1979

[51] Int. Cl.[2] ..... A41B 9/00

[52] U.S. Cl. ..... 2/114; 2/DIG. 7

[58] Field of Search ..... 2/114, 74, 105, 106, 2/DIG. 7

[56] References Cited

U.S. PATENT DOCUMENTS

| | | | |
|---|---|---|---|
| 3,218,649 | 11/1965 | Ricter | 2/114 |
| 3,473,167 | 10/1969 | Jeffrey | 2/106 |
| 3,492,673 | 2/1970 | Zamist | 2/DIG. 7 |
| 3,751,730 | 8/1973 | Zamist | 2/114 |

*Primary Examiner*—Werner H. Schroeder
*Assistant Examiner*—Doris L. Troutman
*Attorney, Agent, or Firm*—Weingarten, Maxham & Schurgin

[57] ABSTRACT

A patient's hospital gown having two flaps formed thereon, one of which is adapted to overlap the other and to be wrapped around the body of the patient for attachment to the other of the flaps. The flaps of the hospital gown may be secured to one another by any suitable means, such as straps or release fasteners.

11 Claims, 6 Drawing Figures

PATIENT'S HOSPITAL GOWN

FIELD OF THE INVENTION

This invention relates in general to bed clothing and more specifically to gowns to be worn by a patient while in a hospital, or in a doctor's examination room.

BACKGROUND OF THE INVENTION

Hospital gowns worn by patients generally consist of a unitary sheet of material having holes thereon for insertion of the patient's arms and they are roughly shaped to conform to a patient's body. Some gowns are wrapped around the body, and slots are employed to permit insertion of straps therethrough. However, most such garments are worn so that sides thereof are attached together by three or four straps arrayed along each side in a straight, vertical line, and the straps are located generally along the back of the patient. There is no overlap of the sides or any other portions thereof. One gown of this type is shown in U.S. Pat. No. 3,557,385. This commonly used gown may be inexpensive to produce and relatively easy for an attendant to remove, but is has certain disadvantages for the patient. One of them is that the gown is usually donned from the front and the straps must be tied together to the rear of the patient. This makes it very difficult for a patient to dress and undress himself, especially if he has difficulty using his arms. A second disadvantge is that private areas to the rear of the patient are often inadvertently exposed, especially if the garment does not fit snugly or if the straps become unattached. If the straps do become undone, it is often very difficult for the patient to reattach them. Even if the garment is worn so that the sides are attached along the front of the patient, private areas in the front of the patient are often exposed, much to his embarrassment. A third disadvantage is that if it is desired to examine the front of the patient, the garment must either be ripped, or it must be removed entirely.

Some hospital gowns presently available, such as that found in U.S. Pat. No. 2,701,364, provide frontally disposed flaps for ease of examination. However, these garments are still secured together along the back of the patient, thereby making it difficult for the patient to dress and undress himself. In addition, because of the lack of overlap, there is still the possibility of patient exposure. Other gowns designed for complete coverage of the patient are neither comfortable nor medically desirable. These gowns are often difficult to remove from the patient in emergency situations and have a tendency to bind or constrict the patient, thus restricting his movements or preventing the proper circulation of blood while the patient is in a prone position.

Presently existing hospital patient gowns are inherently uncomfortable and unflattering to the patient, especially because of the tendency to expose private areas of the patient. Obviously, such gowns cannot be made in a variety of sizes and styles because of the cost involved, and thus, hospital gowns of the type presently on the market tend to be unattractive and dehumanizing. These gowns tend to depress and embarrass the patient, and this negative psychological impact can affect patient recovery and discourage the patient from leaving his bed.

SUMMARY OF THE INVENTION

In view of the foregoing, it is one object of this invention to provide a low-cost patient's hospital gown that functions efficiently for its intended purpose, that is comfortable to wear and that adequately covers the patient's body. It is also an object of this invention to provide a garment which may be donned or removed by the patient or a doctor who wishes to examine a certain portion of the patient's body.

The patient's hospital gown of this invention includes a two-dimensional contoured torso portion formed of sheet material having fabric properties. Holes are provided for placement of the arms, and the torso portion is designed such that the patient may don the gown either from the front or from the rear, much as he would an ordinary article of clothing. The torso portion is contoured to fit over the shoulders and around the neck of the patient. Two flaps are attached to the torso portion, one flap being adapted to be wrapped around the front of the patient. The other flap is adapted to overlap the one flap and straps attached to the flaps are adapted to be wrapped entirely around the patient's body so that they may be secured together along the front or side of a patient in an easily accessible location.

Because of the wrap-around nature of the patient's hospital gown, one size garment may fit patients of widely varying weights and heights. This garment provides complete coverage of the body and is easily donned by the patient. A doctor may detach either the one flap or the other flap and unwrap it as desired to examine certain portions of the patient's body. Since all flaps and portions thereof may be attached along the side of the patient, the gown may be easily removed from the patient whether he is on his back or his front, since the areas of attachment are easily accessible from either side. In addition, the other flap is designed so that it can be easily removed without becoming entangled with the patient.

BRIEF DESCRIPTION OF THE DRAWINGS

The objects, advantages and features of this invention will be more clearly appreciated from the following detailed description when taken in conjunction with the accompanying drawing in which.

DETAILED DESCRIPTION OF THE PREFERRED EMBODIMENTS

Figure 1:
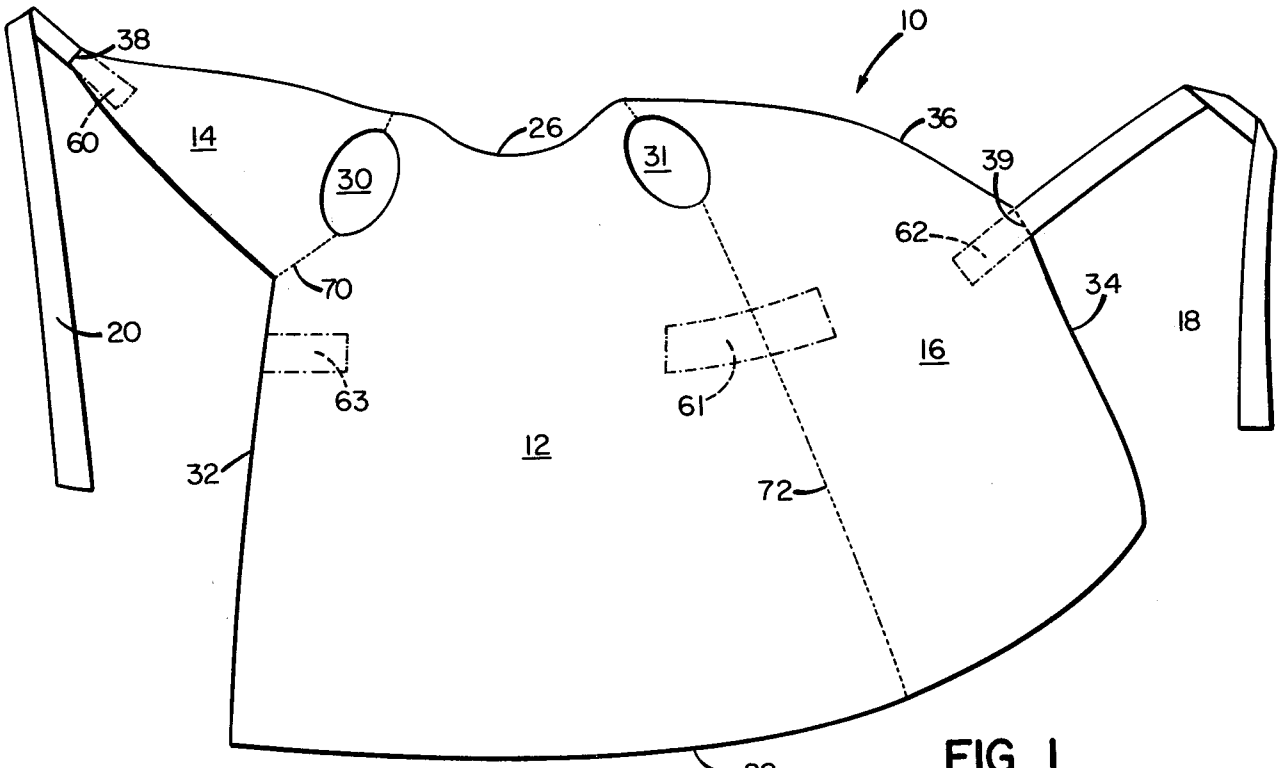
FIG. 1 illustrates a front view of the gown of this invention flattened in a vertical plane to show the interconnection of the several parts.
Figure 2:
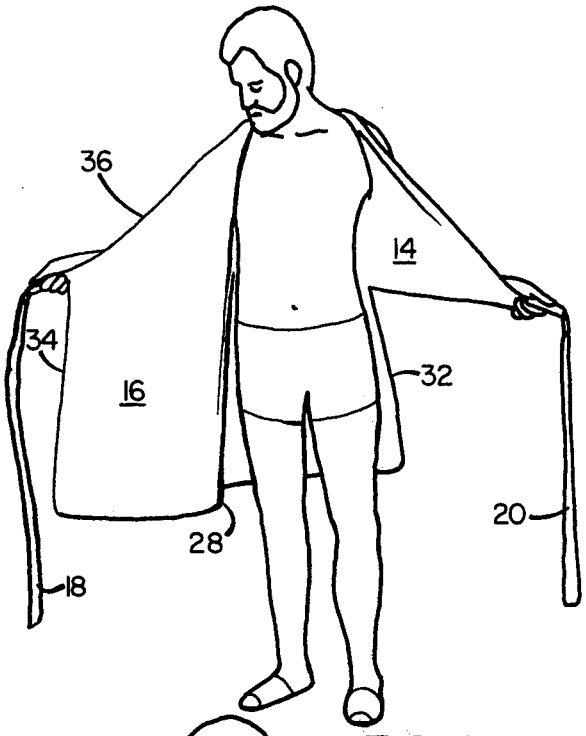
FIG. 2 illustrates a front view of the gown as it is being donned from the rear.
Figure 3:
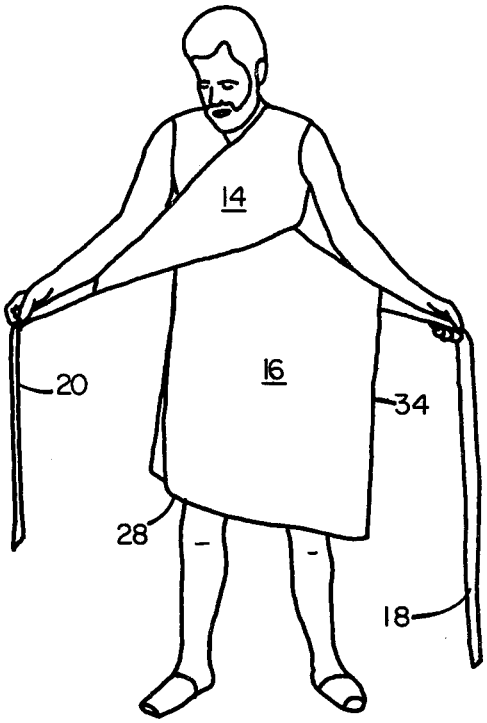
FIG. 3 illustrates another front view of the gown donned from the rear as it is being wrapped around the patient.
Figure 4:
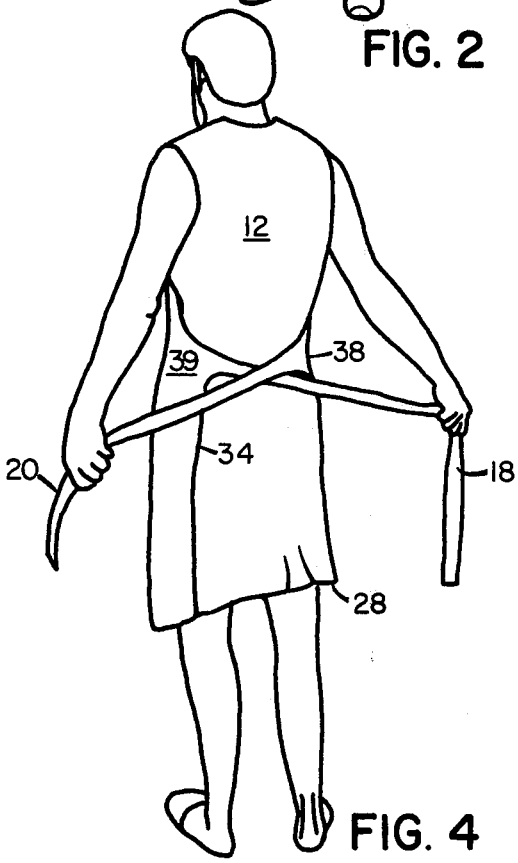
FIG. 4 illustrates a rear view of the gown as it is being donned from the rear.
Figure 5:
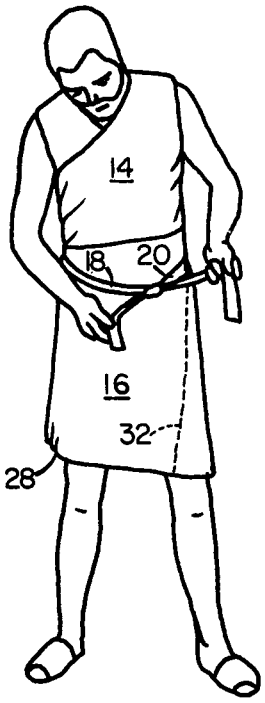
FIG. 5 illustrates a front view of the gown on a wearer in a fully donned position from the rear.

With reference now to the drawing and more particularly to FIG. 1 thereof, there is shown a patient's hospital gown 10 having a contoured torso portion 12. Torso portion 12 has slots 30 and 31 for placement of a patient's arms therethrough. Torso portion 12 includes a contoured neck portion 26 which is adapted to sit atop a patient's shoulders and fit snuggly around a patient's neck when the gown is donned. Slots 30 and 31 are positioned about neck portion 26 so that the gown fits comfortably around a patient. Lower edge 28 of torso portion 12 is adapted to be wrapped around a patient's legs in the general vicinity of the patient's knees. Gown 10 further includes flap 14 and flap 16. Flap 14 is substantially triangular in shape and extends from an upper section of side 32 adjacent slot 30 of torso portion 12. Flap 14 is adapted to be wrapped around a patient as will be more clearly described with reference to FIGS. 2–5. Flap 16 is substantially trapezoidal in shape and extends from torso portion 12 on a side opposite that of flap 14. Flap 16 is adapted to be draped across either the front or the back of the patient so that edge 34 thereof overlaps edge 32 of torso portion 12. The latitudinal width of the upper portion of flap 16 decreases uniformly from the vicinity of point 39 to a position adjacent the patient's neck so that when the gown is donned, edge 36 is aligned in a slanted configuration across the front or the back of the patient's body from one side to the other, as shown in FIG. 3. This configuration permits flap 14 to overlap flap 16 across the upper portion of the patient's torso, as shown in FIG. 3. Flaps 14 and 16 are adapted to completely cover the front of a patient's body when flap 14 is draped over flap 16, as shown in FIG. 5.

Strap 20 is affixed at one end thereof to corner 38 of flap 14 and extends outwardly therefrom and from torso portion 12. Strap 20 is preferably sufficiently long so that when flap 14 is wrapped across the front or back of a patient's body, strap 20 may be wrapped all the way around the patient at least once. A second strap 18 extends from flap 16 at point 39, at the intersection of edges 34 and 36. Strap 18 preferably is long enough to be wrapped at least once around a patient's body so that it may be secured to strap 20 along the side or front of the patient. Strap 18 may also be secured to strap 20 in the vicinity of point 39 without first being wrapped around the patient. In such a case, strap 18 need not be more than twelve inches (30.48 cm) long. Straps 18 and 20 are preferably secured together by means of a knot or by any other common means of attachment. If strap 18 is wrapped around the patient, the point at which it is secured to strap 20 may be any place around the patient, preferably in the vicinity of his waist, that is convenient for the person effecting the attachment.

Flaps 14 and 16 are preferably sewn or otherwise attached to torso portion 12 at seams 70 and 72, respectively. Slots 30 and 31 may be formed between flap 14 and torso portion 12 and between flap 16 and torso portion 12, respectively. However, the gown may also be cut whole from a material, and no seams would be necessary. The gown may also be provided with sleeves for the arms of the patient at slots 30 and 31.

The use and application of gown 16 will now be fully described with reference to FIGS. 2–5. As shown in FIG. 2, the gown 10 is initially donned by the patient by placing torso portion 12 behind him and extending his arms through slots 30 and 31. Flap 14 is held in the left hand while flap 16 is held by the right hand. As shown in FIG. 3, flap 16 is then draped across the front of the body from right to left and is grasped by the left hand of the patient. Subsequently, flap 14 is draped across the front of the body from left to right, overlapping upper portions of flap 16, and flap 14 is grasped in the right hand of the patient. Flap 14 is then wrapped around the right side of the patient's body, as shown in FIG. 3, and strap 20, extending therefrom, is wrapped the rest of the way around the patient to his rear from his right side to his left side until an end of strap 20 is located adjacent the front of the patient and may be grasped in the patient's left hand, as shown in FIG. 4. Simultaneously with the above operation, strap 18, extending from a corner of flap 16, is wrapped around the rear of the patient from the left side to the right side and is grasped in the right hand of the patient, as shown in FIG. 4. Straps 20 and 18 may then be tied together across the front or the left side of the patient, as is shown in FIG. 5. If desired, strap 18 also may be tied to strap 20 along the left side of the patient without first wrapping strap 18 around the patient.

As can be seen from FIGS. 4 and 5, the patient is now completely covered by the gown from his neck generally down to below his knees, and he is not exposed, embarrassed or dehumanized. The gown is wrapped around the patient without the need of passing straps through slots. The gown may be worn as loosely or as tightly as the patient desires, merely by adjusting the tightness of straps 20 and 18. In a like manner, one gown may be adjusted to fit any size person depending upon the degree of overlap of torso portion 12 by flaps 14 and 16 and upon the point at which straps 18 and 20 are tied together. If it is desired to examine the patient, straps 18 and 20 may be undone and flap 14 may be unwrapped alone for examination of certain portions of the upper torso, while flap 16 may be unwrapped alone if it is desired to examine portions of the patient below the upper torso area. In a similar manner, flaps 14 and 16 may be unwrapped together if it is desired to examine the entire vertical extent of a facing portion of a patient's body. If it is desired to treat the patient in an emergency, the gown may be untied and unwrapped with a minimum of effort whether the patient is on his back or on his face.

In an alternative embodiment, hook and loop strip release fasteners may be used in place of straps 18 and 20, as shown by fasteners 60 and 61 and 62 and 63 in FIG. 1. A common example is Velcro tabs. If such fasteners are used, fastener 60 on flap 14 in the vicinity of point 38 would then be attached to flap 16 by mating fastener 61. A series of fasteners 61 could be provided on flap 16 to permit it to be attached to flap 16 at different positions thereon, so that the gown could be adjusted for patients of varying circumference and for patients desiring greater degrees of tightness of fit.

As another alternative, a fastener could be provided on strap 20, and strap 20 could be secured to fastener 61 after strap 20 has been wrapped around the rear of the patient. In a similar manner, a fastener 62 would be mated with fastener 63 to secure flap 16 to torso portion 12.

Figure 6:
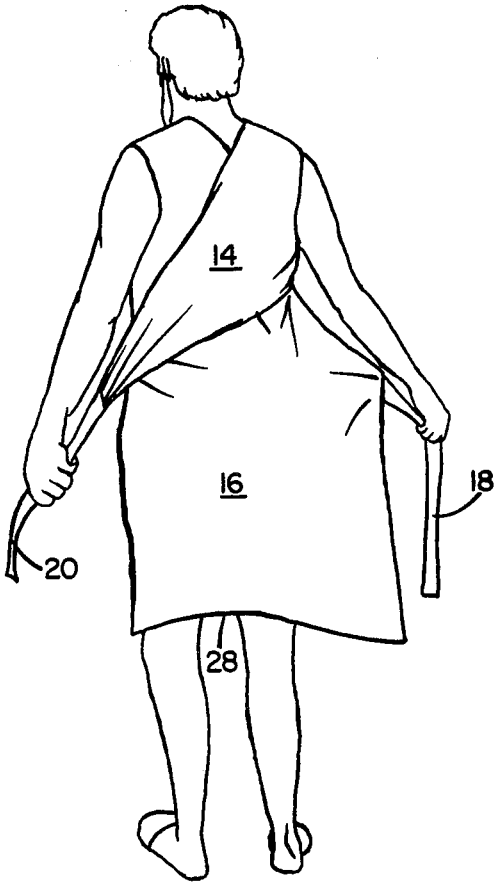
FIG. 6 illustrates a rear view of the gown being donned from the front of a patient.

The hospital gown of this invention may be donned from the front as well as the rear of a patient, as shown in FIG. 6. In such as instance, torso portion 12 would cover the front of the patient and flaps 14 and 16 would overlap across the rear of the patient, and straps 18 and 20 would cross in front of the patient, where they could be tied together. In all other respects, the gown would be donned as previously described.

With respect to materials, the gown may be formed from any sheet material having fabric properties; examples are muslin, cotton or paper.

In view of the above description, it is likely that modifications and improvements will occur to those skilled in the art which are within the scope of this invention.

What is claimed is:

1. A one-piece patient's hospital gown comprising:

a torso portion contoured to be wrapped around the front or back of a patient and to conformally fit around the patient's neck, said torso portion having two spaced openings each adapted for placement of a respective patient's arm therethrough, and an edge disposed substantially longitudinally with respect to said patient;

a first flap extending from said torso portion and having a body portion adapted to be draped across the other of said front or back of a patient than said torso portion, and a neck portion adapted to be placed adjacent to the neck of a patient, said first flap having a width which increases from said neck portion to said body portion;

a second flap extending from said torso portion oppositely from said first flap and at the upper end of said edge and adapted to be draped across the front or back of a patient in overlapping relationship with the neck portion of said first flap; and means for securing the ends of said first and second flaps to maintain substantial coverage of underlying portions of the patient's body.

2. The patient's hospital gown of claim 1 wherein said second flap is further adapted to be wrapped around said torso portion while in an overlapping relationship with said neck portion of said first flap so that a terminal end thereof is closely adjacent said edge.

3. The patient's hospital gown of claim 2 wherein said securing means comprises Velcro tabs.

4. The patient's hospital gown of claim 1 wherein said securing means comprises flexible, elongated straps.

5. The patient's hospital gown of claim 1 wherein said securing means comprises:

a first elongated strap attached to said body portion of said first flap, and adpated to be wrapped around a patient's body at least once; and a second elongated strap attached to a terminal end of said second flap and adapted to be wrapped around a patient's body so as to extend from said terminal end to at least a position adjacent said edge when said second flap is in an overlapping relationship with said neck portion of said first flap;

said first strap and said second strap being adapted to be secured together by means of a knot formed therebetween.

6. The patient's hospital gown of claim 1 or 5 wherein said first flap and said second flap are adapted to be selectively unwrapped from said patient.

7. The patient's hospital gown of claim 3 or 5 wherein said first flap, said second flap and said torso portion are comprised of a fabric-like material.

8. The patient's hospital gown of claim 1 or 5 wherein said first flap is substantially trapezoidal in shape and wherein said first flap includes one border substantially coextensive with a boundary of said torso portion and another border substantially parallel to said one border.

9. The patient's hospital gown of claim 1 or 5 wherein said second flap is substantially triangular in shape and wherein said second flap includes a base adjacent said edge and coextensive with a section of said torso portion and two legs extending outwardly from said base and joining to form an apex at the distal end of said second flap.

10. The patient's hospital gown of claim 1 or 5 wherein said torso portion is substantially quadrilateral in shape and wherein said torso portion includes an upper edge adapted to fit snugly around a patient's neck, and a lower edge adapted to be wrapped partially around a patient's legs and wherein said openings are arranged about said upper edge to conform to the location of a patient's arms with respect to the patient's neck.

11. A one-piece hospital patient's gown comprising:

a substantially quadrilaterally shaped torso portion adapted to be wrapped around the back of a patient, said torso portion having an upper edge contoured to fit snugly about a patient's neck, two spaced openings disposed about said upper edge, each opening being adapted for placement of a respective patient's arm therethrough, a lower edge adapted to be wrapped about a patient's legs, a first side edge and a second side edge, said first and said second side edges being disposed substantially longitudinally with respect to said patient;

a substantially trapezoidally shaped first flap extending from said first side edge and having a body portion adapted to be draped across the front of a patient and a neck portion adapted to be placed adjacent the neck of a patient, said first flap having a width which increases uniformly from said neck portion to said body portion so that an upper edge thereof is angularly disposed across a patient's upper body when said first flap is in a draped condition;

a substantially triangularly shaped second flap having a base coextensive with an upper section of said second side edge adjacent said upper edge of said torso portion and two legs extending outwardly from said base joining to form an apex, said second flap being adapted to be draped across the front of a patient in an overlapping relationship with said upper edge of said first flap;

a first strap extending from said body portion of said first flap and adapted to be wrapped therefrom around a patient's body at least once; and a second strap extending from said apex of said second flap and adapted to be wrapped therefrom around a patient's body at least once so that a length thereof is adjacent said first side edge;

said first and said second straps being adapted to be secured together at a desired location adjacent the front of the patient to maintain said first flap and said second flap in a draped condition with respect to the patient.

* * * * *